US005423268A

United States Patent [19]

Bounds

[11] Patent Number: 5,423,268

[45] Date of Patent: Jun. 13, 1995

[54] RAILROAD HOPPER CAR WITH BALLAST DISTRIBUTING BLADE AND HOPPER DOOR AND BLADE CONTROL APPARATUS AND METHOD

[75] Inventor: Ivan E. Bounds, St. Joseph, Mo.

[73] Assignee: Herzog Contracting Corporation, St. Joseph, Mo.

[21] Appl. No.: 149,991

[22] Filed: Nov. 10, 1993

Related U.S. Application Data

[63] Continuation-in-part of Ser. No. 986,600, Dec. 7, 1992, Pat. No. 5,311,822.

[51] Int. Cl.[6] ..... B61D 7/30

[52] U.S. Cl. ..... 105/311.1; 105/240; 105/241.2; 105/283; 104/2; 222/504; 37/104; 37/405

[58] Field of Search ..... 105/240, 241.2, 280, 105/283, 286, 311.1; 104/2, 12; 222/504; 298/24, 31, 35 M; 37/104, 105, 106, 107; 171/16

[56] References Cited

U.S. PATENT DOCUMENTS

| | | | |
|---|---|---|---|
| 2,989,930 | 6/1961 | Flowers | 105/248 |
| 3,191,944 | 6/1965 | Watts | 222/504 X |
| 3,295,704 | 1/1967 | Gillick et al. | 105/311.1 X |
| 3,371,826 | 3/1968 | Speno | 105/240 |
| 3,446,373 | 5/1969 | Krister, Jr. et al. | 105/240 |
| 3,596,565 | 8/1971 | Atkinson | 105/240 X |
| 3,654,872 | 4/1972 | Fearon | 105/239 |
| 3,682,332 | 8/1972 | Fearon | 414/400 |
| 3,701,320 | 10/1972 | Fearon et al. | 104/6 |
| 3,717,110 | 2/1973 | Miller | 105/284 |
| 3,822,650 | 7/1974 | Fearon | 105/239 |
| 3,838,649 | 10/1974 | Barnard | 105/240 |
| 3,877,160 | 4/1975 | Plasser et al. | 37/104 |
| 3,877,384 | 4/1975 | Fearon et al. | 104/6 |
| 4,009,664 | 3/1977 | Fearon | 105/239 |
| 4,249,325 | 2/1981 | Theurer | 104/2 X |
| 4,282,663 | 8/1981 | Theurer | 37/104 |
| 4,325,308 | 4/1982 | Erfurth | 105/280 |
| 4,359,176 | 11/1982 | Johnson | 105/240 |
| 4,601,244 | 7/1986 | Fischer | 105/240 |
| 4,766,820 | 8/1988 | Ritter et al. | 105/240 |
| 5,038,966 | 8/1991 | Olk | 105/282.1 X |
| 5,094,018 | 3/1992 | Theurer et al. | 104/2 X |
| 5,115,748 | 5/1992 | Westlake | 105/286 |
| 5,144,895 | 9/1992 | Murray | 105/286 |

FOREIGN PATENT DOCUMENTS

| | | | |
|---|---|---|---|
| 930612 | 7/1973 | Canada . | |
| 480756 | 9/1924 | Germany | 37/105 |
| 724378 | 3/1980 | U.S.S.R. | 105/311.1 |

*Primary Examiner*—Robert J. Oberleitner
*Assistant Examiner*—S. Joseph Morano
*Attorney, Agent, or Firm*—Litman, McMahon & Brown

[57] ABSTRACT

A ballast distributing railroad car has a number of ballast hoppers, each with a selectively operable hopper door. The railroad car also has a pair of ballast distributing blades pivotally attached beneath it, one at either end of the car, with the blades being mirror images of each other. Each blade can be selectively raised and lowered via an independent hydraulic actuator. A remote control radio transmitter and car mounted receiver provide for remote, individual and selective control of hopper doors and blades on a car. When there are a plurality of ballast cars on a train, each car has a receiver which responds to a different address sequence. The remote transmitter is operable to selectively send any of the different address sequences so that a single selected car can be remotely controlled. In a modified arrangement, each ballast distributing blade has a pair of extendable wings on either side to allow the wider distribution of ballast where needed. The wings are operated via individual hydraulic actuators which are also selectively controllable via the remote transmitter.

28 Claims, 7 Drawing Sheets

RAILROAD HOPPER CAR WITH BALLAST DISTRIBUTING BLADE AND HOPPER DOOR AND BLADE CONTROL APPARATUS AND METHOD

CROSS-REFERENCE TO RELATED APPLICATIONS

This application is a continuation-in-part of application Serial No. 07/986,600 filed Dec. 7, 1992, now U.S. Pat. No. 5,311,822.

BACKGROUND OF THE INVENTION

The invention relates to a ballast hopper door and blade control apparatus and method for controlling a plurality of hopper discharge doors and a pair of ballast distributing blades on a railroad ballast car.

Railroad ballast has traditionally been discharged and/or spread by specially designed hopper cars called "ballast cars". In such cars, the ballast is discharged through hopper doors positioned beneath the hopper. In the past, when such doors were positioned directly beneath the car, ballast discharged therefrom was spread by hand, a labor intensive task, or by an additional specially equipped railroad car which followed the ballast hopper car.

These problems were addressed in Patent No. 3,654,872 ('872 patent) in which a ballast car has four hoppers, each of which is provided with a bottom-mounted discharge opening with a discharge control member inserted therein.

The discharge openings are centered over a rail and each discharge control member is a pivotable structure with a pair of side walls extending at an angle outward from an arcuate top surface. A bottom wall connects the side walls and a pair of end walls extend past the side walls to form channels on either side of the discharge control member. The discharge control member is attached at a pivot point positioned below the discharge opening. The arcuate top surface covers the discharge opening when the discharge control member is pivoted to a center position. When the discharge control member is pivoted to one side or the other, the discharge opening is partially opened and ballast is released through the channel formed by one of the angled side walls and the end walls and is thus directed to an associated side of the railroad rail. By selectively pivoting the discharge control member, a proper amount of ballast is directed to a desired position which minimizes or eliminates subsequent spreading requirements. On ballast cars containing pairs of side-by-side hoppers, ballast can be selectively distributed inside or outside of each rail to further minimize spreading requirements.

While representing a significant improvement over prior ballast hopper cars, the hopper car door discharge control member in the '872 patent is controlled by a hand-operated lever. Thus, the control opening or openings on each ballast car must be set by hand when the train is stationary and cannot be adjusted once the train is in motion.

It is clear that a need exists for an improved ballast car with ballast distributing blades and a control apparatus and method therefor. The apparatus and method should include power actuators which are remotely controllable to allow control of ballast distribution while a train including the ballast car is in motion. Such an apparatus and method should also provide for the selective adjustment of any one ballast car in a train carrying multiple ballast cars and the individual and selective control of multiple hopper doors and/or ballast distributing blades on a single ballast car.

SUMMARY OF THE INVENTION

In a first embodiment, the present invention is a remotely controlled power hopper door control apparatus and method for a railroad ballast car or the like. The apparatus comprises a conventional pivotable discharge control member, as taught by the '872 patent, which member is pivotally mounted in a hopper door discharge opening located beneath a hopper on the ballast car. A drive shaft extends through the discharge control member at the pivot point and a sealed gear-driven transmission is attached to one end of the drive shaft. A reversible electric motor is connected to the transmission via a reduction gear to drive the transmission, and thus the drive shaft, in either direction. The motor is controlled by relays which are, in turn, selectively operated by a radio receiver. A remote radio transmitter and control keyboard is adapted to send selected control command signals to the receiver. These commands include IN and OUT and emergency stop control signals.

In addition, different ballast cars in a single train are equipped with receivers responsive to different address sequences. The remote radio transmitter includes a numeric keyboard which is operable to select different ones of said address sequences and thus to control different ballast cars in the same train. Multiple hoppers on a single car are also selectively controllable as well.

In a second embodiment of the invention, a ballast car includes a plurality of hoppers, each of which is provided with a pair of spaced hopper openings. Each hopper opening is directed downward with a retractable hopper door selectively covering each opening. A pair of ballast distributing blades are pivotally attached to the car, one at either end of the hoppers. Each of the blades forms a shallow "V" shape with the centers of the V's of the two blades facing toward each other. Each blade is equipped with a hydraulic cylinder actuator such that it can be selectively raised to a non-operative position or lowered to a ballast distributing position. Each blade is equipped with two rollers which are positioned to engage respective railroad rails when the blade is in the ballast distributing position.

When ballast is to be distributed, depending upon the direction of movement of the hopper car, one or the other of the blades is lowered to the ballast distributing position and then one or more of the hopper doors are opened to drop ballast between the railroad rails. The lowered blade then trails behind the opened hoppers and pushes the ballast to either side of each rail so that the dropped ballast is distributed to the necessary locations and the rails are cleared of ballast. In an alternative embodiment, each blade is equipped with a pair of wings, each of which is selectively extendable and retractable via a hydraulic actuator to allow the effective width of the blade to be increased.

In a control arrangement which is similar to that of the first embodiment, the hydraulic actuators for the ballast doors, the ballast distributing blades and the extendable blade wings are selectively and individually remotely controllable via a remote radio transmitter and receiver. In addition, individual railroad cars in a train can be selected for such control.

OBJECTS AND ADVANTAGES OF THE INVENTION

The principal objects of the present invention are: to provide an improved railroad ballast car hopper door and distributing blade control apparatus and method; to provide such an apparatus and method in which a pair of ballast distributing blades are mounted at either end of a ballast car, just inside the wheels, with the blades facing each other; to provide such an apparatus and method in which each of the ballast distributing blades can be selectively raised to a non-operative position or lowered to a ballast distributing position; to provide such an apparatus and method in which both a plurality of hopper doors and the distributing blades are controlled by hydraulic actuators; to provide a modified apparatus in which each blade includes a pair of hydraulically extendable and retractable wings for adjusting the overall effective blade width; to provide such an apparatus and method in which each hydraulic actuator is a double-acting cylinder and each cylinder is controlled by a three-way valve; to provide such an apparatus and method in which the valves are controlled by solenoids selectively operated by a car-mounted radio receiver; to provide such an apparatus and method in which a remote radio transmitter and keyboard is adapted to selectively send control signals to the radio receivers in the cars to individually and selectively control each hydraulic valve actuating solenoid on the selected car; to provide such an apparatus and method in which different ballast cars in a train have receivers responsive to different address sequences; to provide such an apparatus and method in which the remote transmitter is selectively controllable to transmit different ones of said address sequences so that individual ballast cars in the train are separately controllable; to provide such a method for remotely, individually and selectively controlling multiple hopper doors and blades on a single ballast car; and, to provide such an apparatus and method which is particularly well adapted for its intended purpose.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE INVENTION

Figure 1:
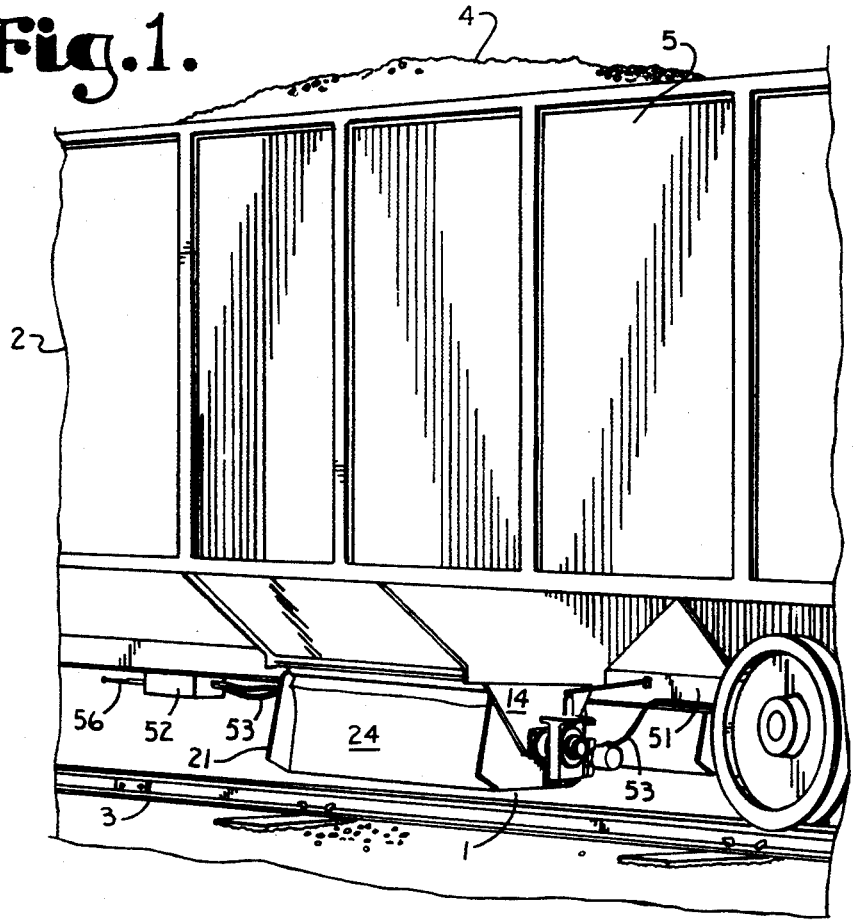
FIG. 1 is a fragmentary perspective view of a railroad ballast car equipped with a hopper door control apparatus according to a first embodiment of the present invention.
Figure 2:
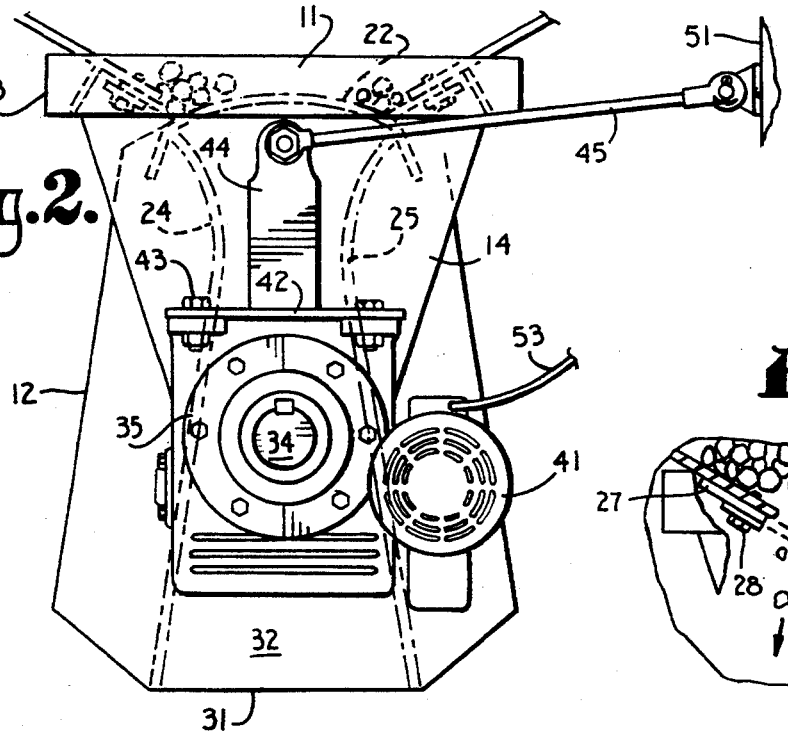
FIG. 2 is an enlarged end view of the hopper door control apparatus of FIG. 1 with the angled side walls and the arcuate top of the discharge control member shown partially in phantom lines.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limited, but merely as a basis for the claims and as a representative basis for teaching one skilled in the art to variously employ the present invention in virtually any appropriately detailed structure.

FIRST BALLAST CAR EMBODIMENT WITH PIVOTING DISCHARGE MEMBER

Referring to FIGS. 1–5, a hopper door control apparatus, generally referenced as 1, is shown in conjunction with a railroad ballast hopper car 2 operating on a pair of railroad rails 3. The car 2 is shown with a load of railroad ballast 4, which usually comprises fine gravel, cinders or the like, for distribution between and on either side of the railroad rails 3.

Typically, the ballast car 2 will include up to 4 separate hoppers 5, each of which has a bottom discharge opening 11. At the bottom of each hopper discharge opening 11 is positioned a ballast discharge control assembly 12. For convenience, only one such opening 11 is illustrated in FIGS. 1, 2, 3 and 5, since each such opening 11 and discharge control assembly 12 is identical.

The discharge control assembly 12 comprises an open top frame member 13 which is placed adjacent to and surrounding the hopper discharge opening 11. A pair of opposed triangular shaped end support plates 14 and 15 are attached at either end of the open frame member 13. A pivoting discharge control member 21 comprises an arcuate top surface 22 with a radius approximately equal to the distance from a pivot point 23 on the end support plates 14 and 15, to the lower end of the discharge opening 11. The arcuate top surface 22 covers the entire discharge opening 11 when the discharge control member 21 is pivoted to a center position to prevent discharge of any of the ballast material 4. A pair of side walls 24 and 25 extend outward from the arcuate top surface 22, with the side walls connected together by a bottom wall 31 and a pair of end walls 32 and 33. The end walls 32 and 33 extend past the side walls 24 and 25 to channel discharged ballast along each of the side walls 24 and 25, thus forming gravity chutes. Each end wall 32 and 33 of the discharge control member 21 is rigidly attached to a pivoting drive shaft 34 (FIG. 5), which extends through openings in both end support plates 14 and 15 and which is attached thereto by a pair of support plates 36 and 37, respectively. A transmission gear assembly 35 is connected to the drive shaft 34 and to a reversible electric motor 41. The motor 41 is operative to turn the drive shaft 34 via a reduction gear assembly (not shown) in the transmission 35. The transmission 35 is bolted onto a horizontal support plate 42 via a plurality of bolt and nut assemblies 43. The horizontal support plate 42 is attached to a vertical support plate 44 which is supported by a rod 45 attached at one end to the top of the support plate 44 and pivotally attached at the other end to a frame member 51 on the railroad car 2.

Figure 4:
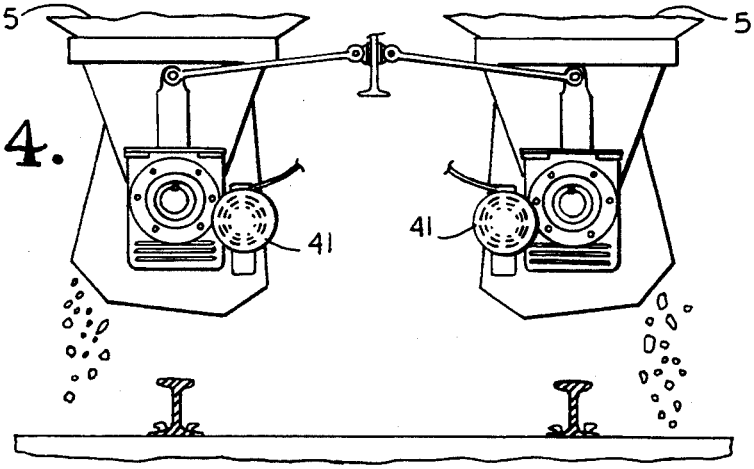
FIG. 4 is an enlarged end view of a pair of hopper door control apparatuses mounted on a ballast car with a set of railroad tracks shown beneath them.
Figure 5:
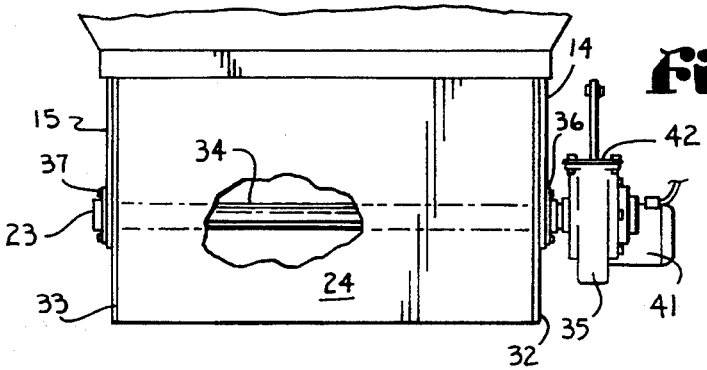
FIG. 5 is an enlarged side elevational view of the discharge control member, transmission and motor, with portions broken away to illustrate the drive shaft.

A single radio receiver 52 (FIG. 1) is mounted on the railroad car 2 in a position which permits radio reception to an antenna 56 with minimal interference from the body of the car 2. The receiver 52 is a conventional receiver capable of receiving an RF signal and decoding a digital address and control signal modulated thereon. Each car 2 has up to four hoppers 5, (two of which are shown in FIG. 4) each of which has a discharge opening 11 and a discharge control assembly 12 including a motor 41. Each motor 41 is connected to the radio receiver 52 via a control and power supply cable 53. The radio receiver 52 can selectively control any of the reversible motors 41 to operate in either direction, thus opening or closing a gap on either side of the associated discharge opening 11. Control of each individual motor 41 is via a pair of conventional corresponding relays 71–78 in a relay bank 70 (FIG. 7) which selectively power the motor or motors 41 in one direction or the other.

Figure 3:
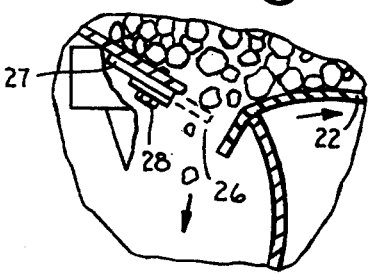
FIG. 3 is an enlarged fragmentary view of a discharge control member of pivoted clockwise to partially open the hopper door.

FIG. 3 depicts one side of the discharge opening 11 with the discharge control member 21 pivoted in the direction of the arrow, this opening a gap 26 between the adjustable steel plate 27 and the arcuate top surface 22. The ballast 4 is thus gravity fed through the gap 26 and along the channel defined by the side wall 24 and the end walls 32 and 33. As the discharge control member 21 is pivoted further to the fight, the gap 26 is widened, thus allowing a greater volume of the ballast 4 to be fed through. The adjustable steel plate 27, which can be an inch thick, is adjustable via slots in the plate (not shown) which engage a bolt 28 attached to the hopper 5. The plate 27 is shown in an extended position in phantom lines.

Figure 6:
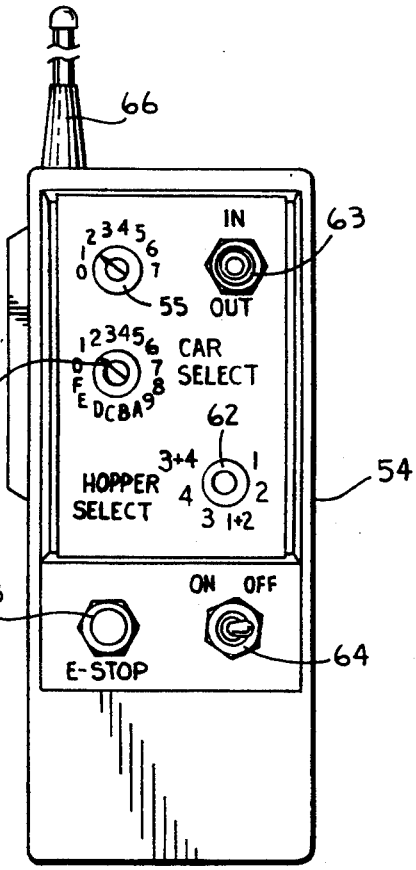
FIG. 6 is a frontal view of a remote control transmitter and keyboard.
Figures 7, 8, 9:
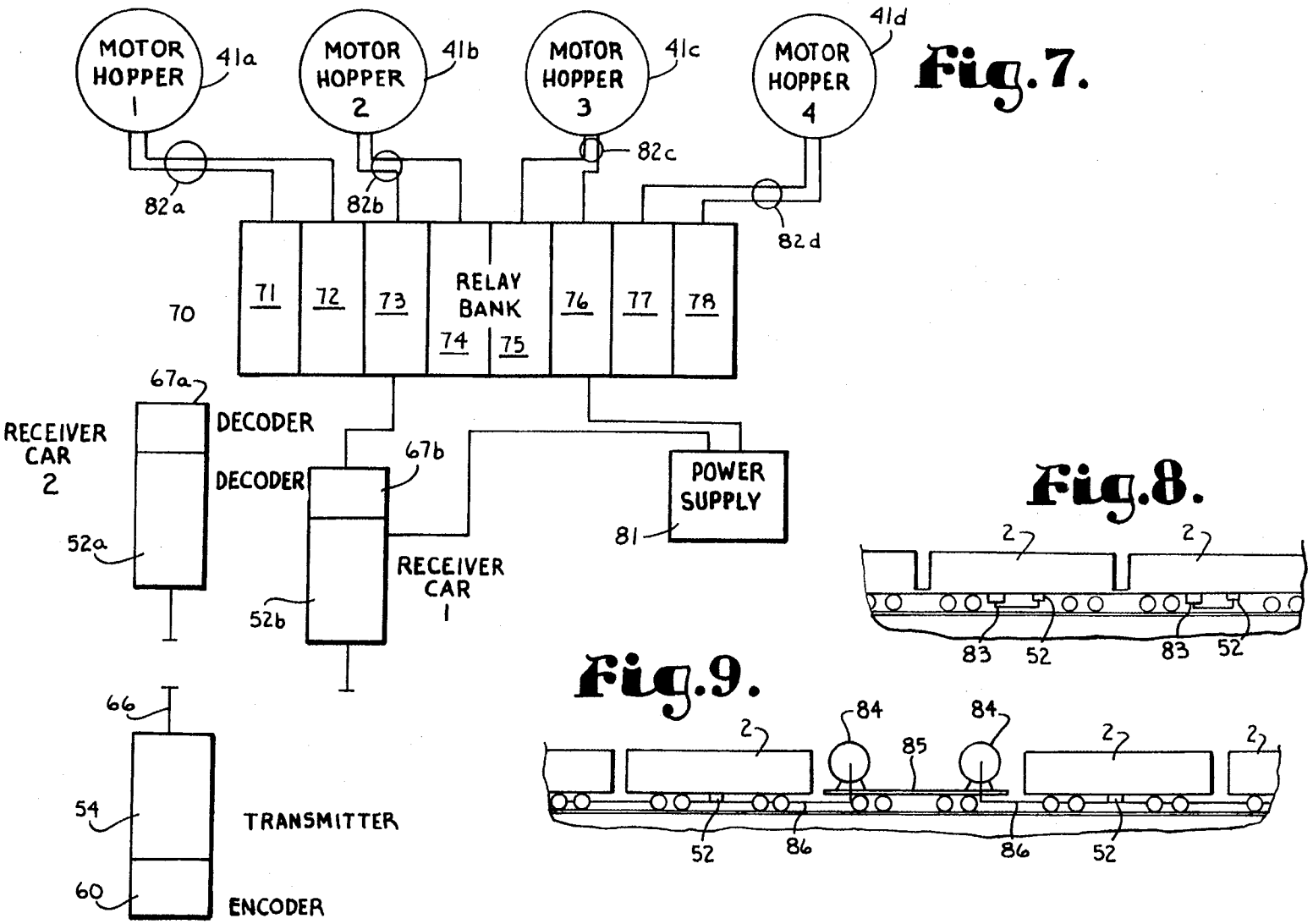
FIG. 7 is a block electrical schematic diagram of a hopper door control system.
FIG. 8 is a reduced side-elevational view of a portion of a train with individual batteries used as hopper door control power supplies.
FIG. 9 is a reduced side-elevational view of a portion of a train with common generators used as hopper door control power supplies.

FIG. 6 illustrates a from control panel for a remote radio control transmitter 54. FIG. 7 is a block electrical schematic of the transmitter 54 with a pair of remote receivers 52*a* and 52*b*. The receiver 52*b* for car 1 is shown complete with a relay bank 70 including eight control relays 71–78. It should be understood that each receiver 52 controls a similar relay bank 70, and that there are as many receivers 52 as there are ballast hopper cars 2 in a train.

Referring to FIGS. 6 and 7, a pair of rotary switches 55 and 61 are operative to select a remote receiver 52 on a particular hopper car 2 in a train of such cars. The selection can be accomplished by, for example, encoding and transmitting a unique digital address via an encoder 60 connected to the transmitter 54 to which only the selected receiver 52 will respond. A third rotary switch 62 is for selecting a particular hopper or pair of hoppers 5 on the selected car 2. As shown in FIG. 4, a pair of the hoppers 5 can be jointly controlled for dumping ballast inside or, alternatively, outside of the rails 3. An IN/OUT toggle switch 63 is used to send an "IN" or "OUT" signal to pivot the selected discharge control member to the inside or the outside of the rails 3. An ON/OFF switch 64 is provided for the transmitter 54 and an Emergency Stop switch 65 sends a stop signal to the selected receiver 52. The receiver 52 then immediately stops all motors 41 on the selected car 2. An RF antenna 66 is mounted on the transmitter 54.

The selected receiver 52 with an associated decoder 67, which is assumed to be the receiver 52*b* and decoder 67*b* of car 1 in FIG. 7, causes one or more of the relays 71–78 to connect power from a power supply 81 to a selected one of or a pair of the motors 41*a*–41*d*. Each of the motors 41*a*–41*d* is connected via a respective wire pair 82*a*–82*d* to a pair of the relays 71–78. For example, the motor 41*a* in hopper 1 is connected to relays 71 and 72. Depending upon which direction of rotation is selected by the IN/OUT toggle switch 63, the relay 71 or the relay 72 is enabled to selectively switch power to the motor 41*a* to cause it to rotate in the selected direction. If a pair of the hoppers 5 are selected via the hopper select switch 62, then a pair of the relays 71–78 are enabled by the addressed receiver 52*b*.

Digital signalling from the transmitter 54 to the selected receiver 52 can be accomplished by any conventional digital coding technique which modulates an RF signal. Pulse width modulation is one of several suitable signalling schemes.

FIGS. 8 and 9 are alternative illustrations of power supply sources for a train containing multiple hopper cars 2, each of which includes a receiver 52 attached thereto. In FIG. 8, each hopper car 2 includes a self-contained battery 83 for powering the receivers 52 and associated relays 71–78 and motors 41. In FIG. 9, a common generator 84, or a pair of such generators 84, are carried on a special car 85, with a common power supply cable 86 providing power to each ballast hopper car 2. Of course, generator power can be provided from a locomotive (not shown) or another common generator source as well.

The operation of the hopper control apparatus 1 will now be described with reference to FIGS. 1–7. A train including a plurality of the ballast hopper cars 2 is positioned onto a pair of the rails 3 which need additional ballast. As the train moves along the rails 3, the first hopper car 2 in the train is selected remotely by an operator, who, for example, may be stationed in the locomotive, by operating the rotary switches 55 and 61 on the transmitter 54. Operation of the correct rotary switch combination causes the transmitter 54 to attach a digitally coded address to any subsequent control message. When the correct car 2 is selected via the rotary switches 55 and 61, the correct hopper 5 and the desired discharge direction must be selected. If, for example, ballast 4 is needed on the outside of both of the rails 3, the rotary hopper select switch 62 is turned to the Nos. 1+2 position. The IN/OUT toggle switch 63 is then flipped to the OUT position and held for a set time. This combination of rotary switch positions for the switches 55, 61 and 62 and the pushing of the toggle switch 63 causes the transmitter 54 to send a digitally encoded signal which includes a leading receiver address sequence and a motor control signal to cause the selected receiver **52*b* to enable the relays 71–74 to control the motors 41*a* and 41*b* in the hoppers 1+2 in a manner to turn the discharge control members 21 in the selected hoppers 5 outward. The receiver 52*b* in car 1 recognizes the lead address and responds to the digital signal in the desired fashion. As long as the IN/OUT toggle switch 63 is held in the OUT position, the digital signal is repeated and the motors 41*a* and 41*b* are continuously turned in the selected direction. When the toggle switch 63 is released, the digital control signal ceases and the relays 71–74 are opened, stopping the motors 41*a* and 41*b*, with the discharge control members 21 held in the selected position. Ballast 4 is thus distributed along the outside of the rails 3 as the train moves. When the selected Nos. 1+2 hoppers 5 on the selected car 2 are empty, the rotary switch 62 is turned to the No. 3+4 position and the IN/OUT toggle switch 63 is again toggled to OUT for a set period. The receiver 52*b* in car 1 thus controls the relays 75–78 in a fashion which causes the motors 41*c* and 41*d* in hoppers 3+4 to turn outward. Similarly, when all four of the hoppers 5 on the first car 2 in the train are empty, the receiver 52*a* in the second car is selected via the rotary switches 55 and 61 and the process is repeated. If ballast 4 is needed on only one side of one of the rails 3, only one of the four hopper motors 41*a*–41*d* is selected and controlled accordingly, and, conversely, if ballast 4 is needed both inside and outside both of the rails 3, the discharge control members 21 on hoppers 1+2 can be pivoted outward while the control members 21 on hoppers 3+4 are pivoted inward, thus distributing ballast 4 inside and outside of both of the rails 3**.

SECOND BALLAST CAR EMBODIMENT WITH BALLAST DISTRIBUTING BLADES

Figure 10:
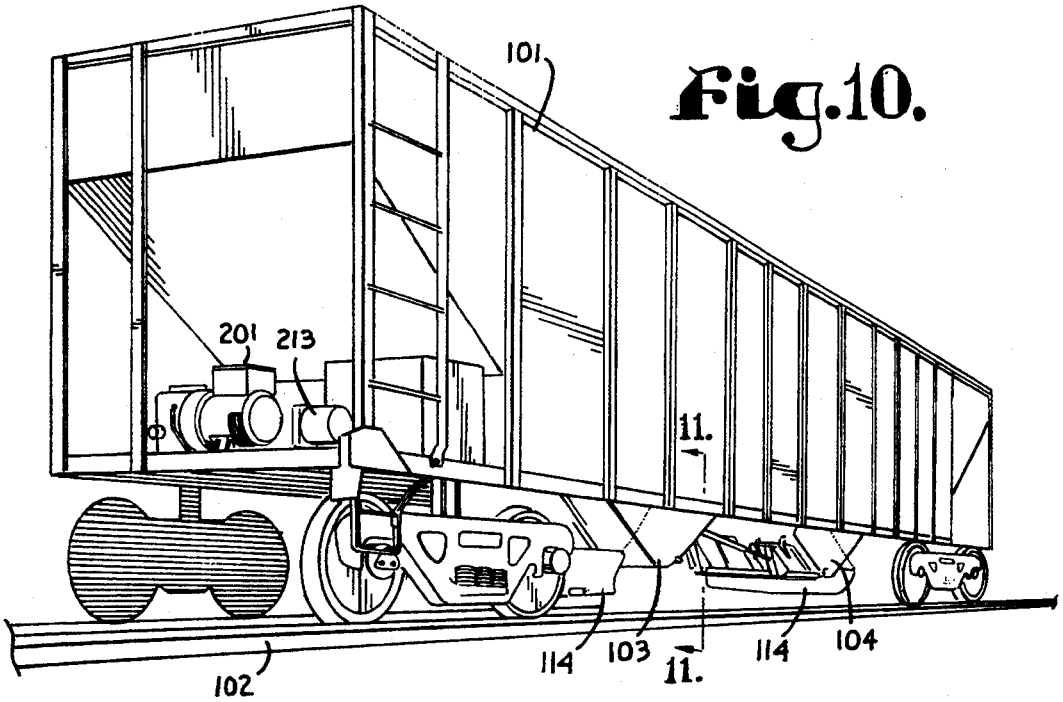
FIG. 10 is a perspective view of a railroad ballast hopper car incorporating a second embodiment of the invention.
Figure 11:
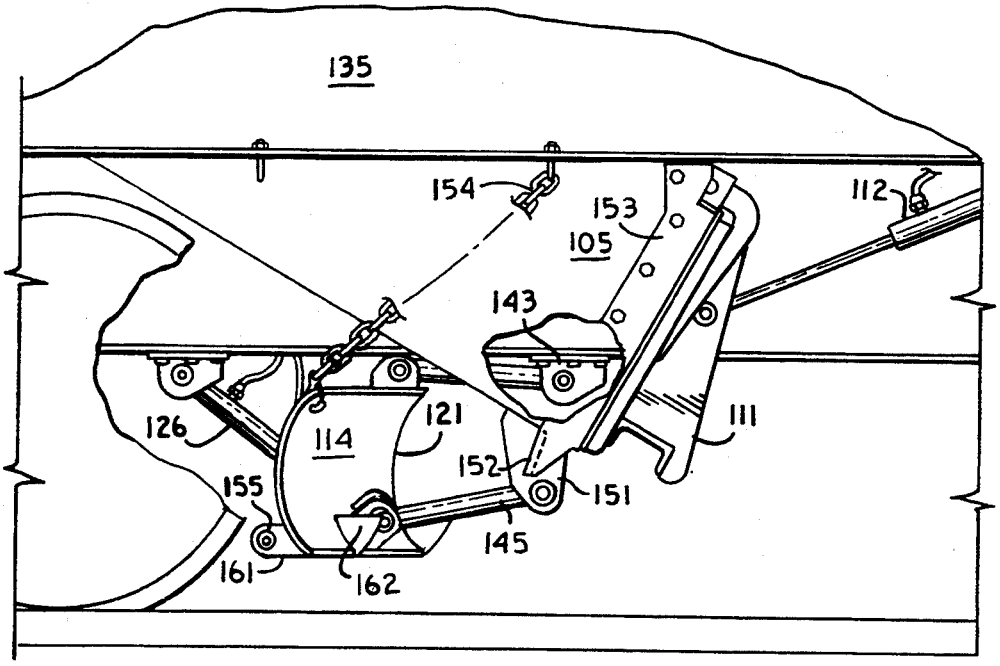
FIG. 11 is an enlarged, fragmentary cross-sectional view of the hopper car of FIG. 10, taken along line 11—11 of FIG. 10, and illustrating the hopper doors closed, an associated ballast distributing blade raised to a non-operative position, with a safety chain secured for transport and with portions broken away to illustrate details of the connection of the blade to the railroad car.
Figure 12:
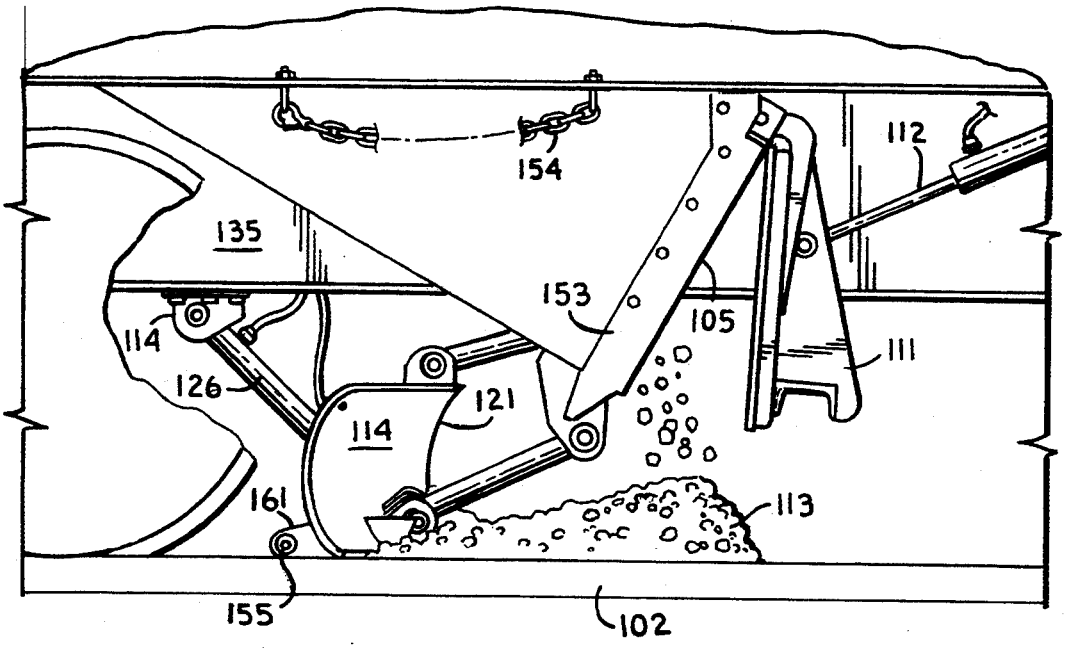
FIG. 12 is an enlarged, fragmentary cross-sectional view of the hopper car of FIG. 10, taken along line 11—11 of FIG. 10, and illustrating the hopper doors opened with ballast dropping out, the associated ballast distributing blade lowered to a ballast distributing position and with the safety chain released.

Referring to FIGS. 10–17, a second embodiment of a railroad ballast car and control system is disclosed. In FIG. 10, a railroad hopper car 101 is shown positioned on a pair of rails 102. A pair of hoppers 103 and 104 are each equipped with a pair of hopper discharge outlets 105, as shown in more detail in FIGS. 11 and 12. The car 101 is conventional and includes a number of hopper doors 111, one for each of the discharge outlets 105. Each of the doors 111 is selectively movable between a closed position, as shown in FIG. 11 and an open position, as shown in FIG. 12 via a hydraulically operated cylinder and piston 112. When the hopper doors 111 are opened, as shown in FIG. 12, ballast 113 is dropped onto and between the rails 102. This dropped ballast must be distributed to the correct locations inside and outside the rails 102.

In order to efficiently distribute the ballast 113, a pair of ballast distributing blades 114 are attached to the car 101. Each blade 114 is positioned just inside a respective wheel carriage 115 on either end of the car 101. Each blade 114 is shaped as a shallow V with a center portion 121 of each respective V projecting inward toward the center of the car 101, as shown in FIG. 11. This arrangement insures that a correctly oriented blade 114 will be available for distributing ballast from the car 101 regardless of the direction of travel of the car 101.

Figure 13:
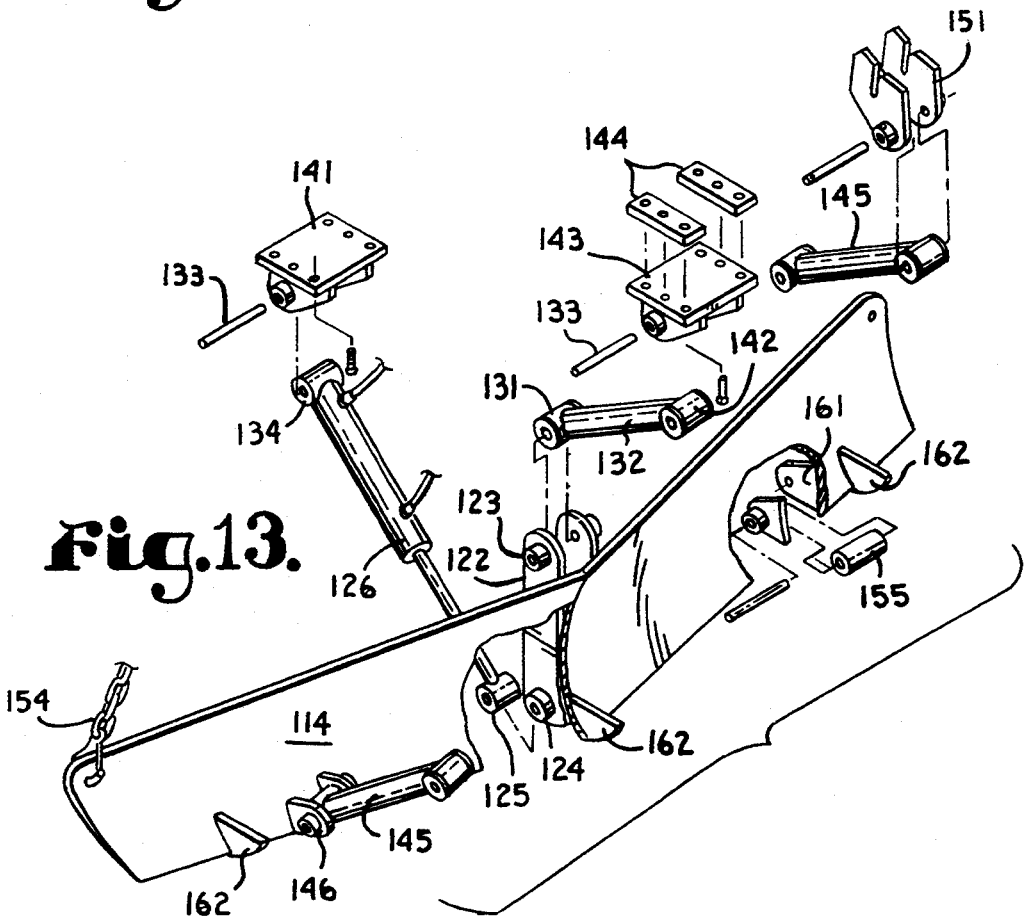
FIG. 13 is an enlarged, exploded perspective view of a ballast distributing blade, illustrating the various components thereof.

The blades 114 are identical and their placement within the car 101 is symmetrical, so that only one of the blades 114 is illustrated in FIGS. 11–13. Referring to FIGS. 11–13, the blades 114 each include a centered, vertically oriented pivot mount 122, with upper and lower pivot connections 123 and 124, respectively. A lower end 125 of a blade elevating hydraulic cylinder 126 is attached to the lower pivot mount 124 while a lower end 131 of a center pivot arm 132 is attached to the upper pivot mount 123, each pivot connection being made via removable pins 133. An upper end 134 of the cylinder 126 is pivotally connected to a center structural member 135 of the car 101 via a mounting plate 141 while an upper end 142 of the center pivot arm 132 is connected to the same structural member 135 via a mounting plate 143. Vertical adjustment of the plates 141 and 142 is accomplished via spacer plates 144. A pair of side pivot arms 145 are each pivotally attached to a pair of pivot mounts 146 welded or otherwise attached to the front of the blade 114 near each side thereof. Only one of the mounts 146 is illustrated in FIG. 13, the other having been broken away to illustrate details of the mounting structure on the rear of the blade 114. Each of the side pivot arms 145 is pivotally attached via a pair of mounting plates 151 to a flange member 152 (shown in phantom lines in FIG. 11) which is welded between a pair of plates 153 surrounding the discharge opening 105.

Referring to FIGS. 11 and 12, again, when the cylinder 126 is retracted, the blade 114 is raised to the position shown in FIG. 11 as the pivot arm 132 and the pivot arm pair 145 are all pivoted upward. In this raised, non-operative position, the blade 114 can be secured for transport via a safety chain 154. FIG. 12 illustrates the safety chain 154 removed from the blade 114 and the cylinder 126 in the extended position, lowering the blade 114 to a ballast distributing position. As the ballast 113 is dropped from the hopper 126, it piles up on and between the rails 102, and the blade 114 then forces the ballast off of the rails 102 to either side and between the rails 102 where it is needed. In order to keep the blade 114 from directly contacting the rails 102, a pair of rollers 155 are attached between respective mounting plates 161 attached behind the blade 114. As shown in FIG. 12, the roller mounting plates 161 are angled down slightly and are spaced to allow the rollers to contact the respective rails 102 to thereby support the blade in a position in which it is slightly suspended above the rails 102. A plurality of cambered ears 162 are attached to the front of the blade 114. The ears 162 cause the blade 114 to ride up and over obstructions such as road crossings, switch tracks, etc.

Figure 14:
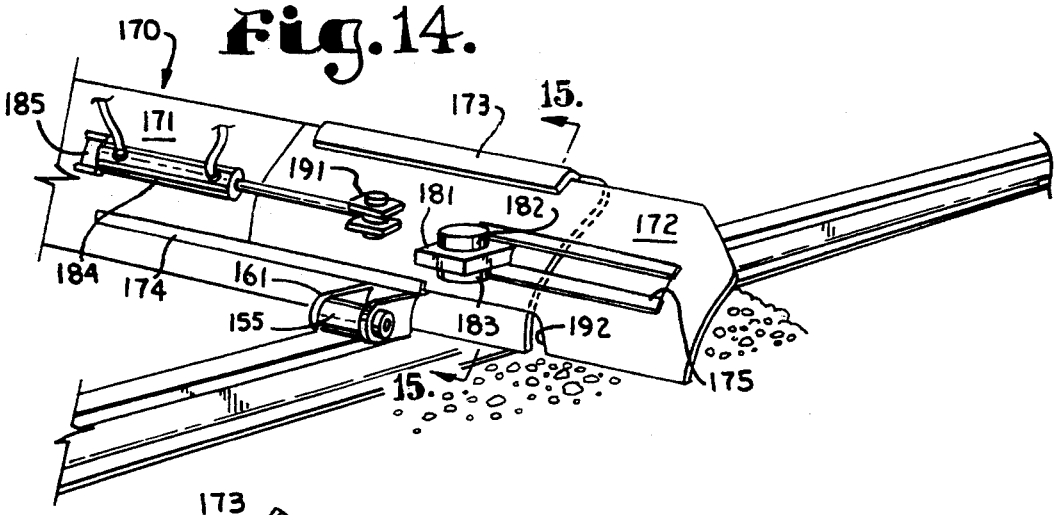
FIG. 14 is a fragmentary perspective view of a modified ballast distributing blade, illustrating one of a pair of retractable blade wings extended.
Figure 15:
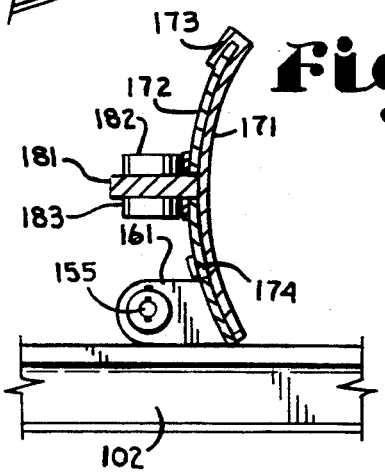
FIG. 15 is an enlarged, cross-sectional view of the modified ballast distributing blade, taken along line 15—15 of FIG. 14, and illustrating the relative positions of the fixed blade and one extendable wing.

Referring to FIGS. 14 and 15, a modified ballast distributing blade assembly 170 is illustrated. The blade assembly 170 includes a fixed blade 171 which is sized and shaped similarly to the blade 114 of FIGS. 10–13. The blade assembly 170 is symmetrical, and thus only one side is shown. In certain applications, such as parallel tracks, railroad yards, etc., it is often necessary to spread ballast well beyond the rails. However, railroad rolling stock is constrained to maximum widths to provide adequate side clearances. For example, in the United States, railroad cars cannot exceed 109" in width. This means that the nominal width of the ballast distributing blades 171, during transport, cannot exceed this width. In order to provide an expanded width for spreading gravel well beyond the rails 102, a symmetrical pair of retractable blade wings 172, of which only one is shown in FIG. 14, are mounted behind the fixed blade 171. Each wing 171 is supported between an upper track 173 and a lower track 174 which are welded to the fixed blade 171. Each wing 172 includes a slot 175 through which a horizontal bearing mounting plate 181 extends. The mounting plate 181 is welded to the rear of the fixed blade 171 and has mounted thereon upper and lower bearings 182 and 183 to provide support to the wing 172 as it is extended and retracted. Selective extension and retraction of the wing 172 is accomplished via a double action hydraulic cylinder 184 which is attached at one end to a mounting bracket 185 on the rear of the fixed blade 171 and at the other end to a mounting bracket 191 on the rear surface of the wing 172. The wing 172 includes a notch 192 along the bottom to accommodate the roller 155 and roller mounting bracket 161 as the wing 172 is extended and retracted. In one embodiment, each wing 172 provides up to a 12" extension on either side of the fixed blade 171 for a potential total blade width of 133".

Figure 16:
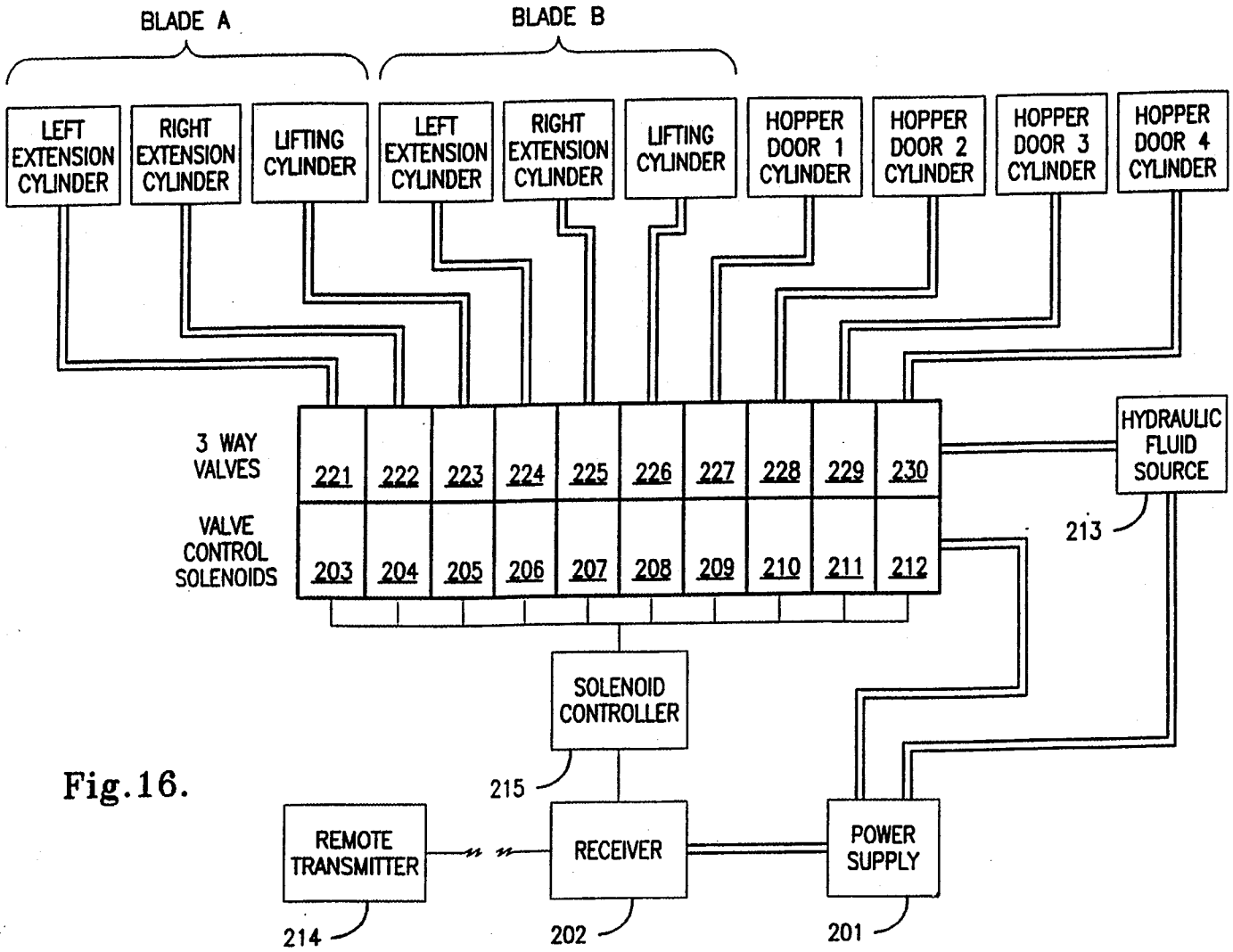
FIG. 16 is an electrical and hydraulic block diagram illustrating a remote control system for the railroad car of FIG. 10.

FIG. 16 illustrates an electrical and hydraulic block schematic diagram for controlling the car 101 of FIG. 10. FIG. 16 is similar to the FIG. _ schematic for controlling the car 2 of FIGS. 1–5. A power supply 201, which may be a car mounted generator as shown in FIG. 10, provides electrical power to a car mounted radio receiver 202, a plurality of valve control solenoids 203–212, and a hydraulic fluid pump 213, also shown mounted on the car 101 as shown in FIG. 10. A remote hand held radio transmitter 214 provides selective and individual control of all of the hydraulic cylinders on the car 101, as well as allowing different cars in a train to be selected for control. The receiver 202 is connected to a solenoid controller 215, which may be a programmable logic controller, for example. The solenoid controller 215 is programmed to selectively provide electrical control signals to the valve control solenoids 203–212 to thereby selectively control a like plurality of 3 way hydraulic valves 221–230. Each of the valves 221–230 is connected to a respective double action hydraulic cylinder via a pair of hydraulic lines, including actuating cylinders for the left and right extendable wings 172 on ballast distributing blade assemblies 170, here designated as blades "A" and "B", as well as the lifting cylinders 126 for each blade. In addition, individual hopper door control cylinders for each hopper door 111 on the car 101, here shown as numbering four, are controlled by the remaining valves 227–230 via the solenoids 209–212, respectively.

Figure 17:
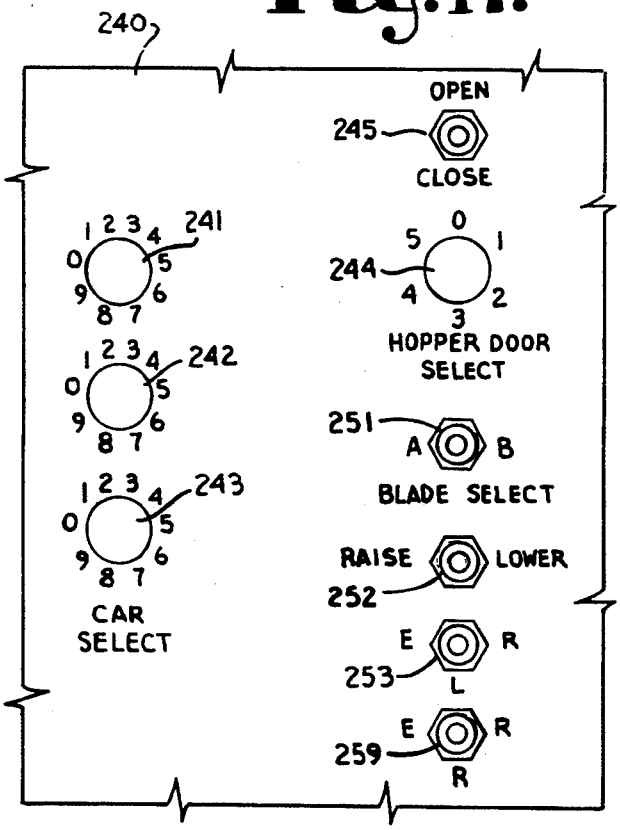
FIG. 17 is a fragmentary frontal view of the control keyboard for a remote control transmitter adapted for remotely controlling the system of FIG. 17.

FIG. 17 illustrates an exemplary keyboard 240 for the remote control transmitter 214, which in all other respects resembles the transmitter 54 shown in FIG. 6. On the left side of the keyboard 240 are three rotary car selection dials 241–243, each with selectable numbers 0–9. By using the dials 241–243 in tandem, a three digit decimal number can be used to uniquely select one of up to 1000 cars for control. Once the car select dials 241–243 are set, a specific and unique car select address code is transmitted to all of the cars 101 on a given train, but only the addressed car will respond to subsequent control signals. These control signals are sent via a hopper door rotary select dial 244, here shown as having 6 selectable hopper doors 1–6. Once a hopper door is selected via the dial 244, an open/close toggle switch 245 is used to open or close the selected hopper door. Next, a blade select toggle switch 251 is used to select the appropriate blade A or B depending upon the direction of travel of the railroad car. Once either blade A or B is selected, a toggle switch 252 can be used to selectively raise or lower the blade. If the selected car is equipped with an extendable blade, such as the blade assembly 170 in FIGS. 14 and 15, then a pair of blade extension/retraction toggle switches 253 and 254 are provided to selectively extend or retract the left and right blade wings, respectively. As in the transmitter 54 of FIG. 6, the combination of rotary switch positions for the switches 241–244 and the pushing of the toggle switches 245 and 251–254 causes the transmitter 214 to send a digitally encoded signal which includes a leading receiver address sequence, a hopper door select sequence, a blade select sequence and one or more hydraulic actuator control signals to cause the selected receiver 202 to enable the solenoids 203–212 to control their respective hydraulic valves 221–230. The receiver 202 in the selected car 101 recognizes the lead address and responds to the digital signals in the desired fashion.

In preferred embodiments, the motor 41 and transmission 35 was a Gearmotor by Helical-Bevel Corp., the pivoting discharge control member 21 was a Ballast Door Size C-45 by Morrison-Knudsen Corp., and the radio transmitters 54 and 214 and receivers 52 and 202 were CATTRON CAT-824E-01 by Cattron, Inc. operating in a frequency range of 450–470 MHz, in which up to 126 unique addresses can be transmitted for each RF channel.

While a digital address signalling scheme has been described for selecting individual cars on a train, it should be apparent that utilizing different carrier or modulating frequencies for each car, or any other suitable manner of selecting individual receivers from a group of such receivers could be employed as well.

It is to be understood that while certain forms of the present invention have been illustrated and described herein, it is not to be limited to the specific forms or arrangement of parts described and shown.

What is claimed and desired to be secured by Letters Patent is as follows:

1. A hopper door and distributing blade control apparatus for controlling one or more of a plurality of hopper doors and one or more ballast distributing blades on a railroad hopper car, comprising:

(a) door operating means associated with each said door for selectively opening and closing the associated door;

(b) blade operating means associated with each said blade for selectively moving said blade between said operative and said non-operative positions;

(c) a receiver on said car connected to the respective door and blade operating means on that car, said receiver being responsive to coded control signals to selectively, independently and individually control positions of each of said doors and said blades; and (d) a mobile remote transmitter selectively operable to transmit said coded control signals to cause said receiver to control the connected door and blade operating means.

2. An apparatus as set forth in claim 1, for use on a train including a plurality of railroad cars, each such car including a plurality of said hopper doors and a plurality of said blade operating means and each such car being equipped with one of said receivers, wherein:

(a) each receiver is adapted to respond to a different coded receiver address signal; and (b) said remote transmitter is selectively operable to transmit any one of said coded receiver address signals along with said control signals to enable a selected one of said receivers.

3. An apparatus as set forth in claim 1, wherein:

(a) said door and blade operating means each comprise a hydraulic actuator.

4. An apparatus as set forth in claim 3, wherein:

(a) said car includes an electrical generator and a hydraulic fluid pump.

5. An apparatus as set forth in claim 1, wherein:

(a) there are a pair of said ballast distributing blades on said car, one blade being attached toward each end of said car, and each said blade has an independent blade operating means.

6. An apparatus as set forth in claim 5, wherein:

(a) each of said ballast distributing blades is shaped as a V, with the center portions of the V blades on each car extending toward each other such that each said car can distribute ballast while said train is in motion in either direction on a railroad track.

7. An apparatus as set forth in claim 5, wherein:

(a) said ballast distributing blades are adjustable and each includes at least one wing portion which is extendable and retractable to selectively change the effective width of said blade.

8. An apparatus as set forth in claim 7, wherein:

(a) each of said adjustable ballast distributing blades includes a pair of said wing portions.

9. An apparatus as set forth in claim 8, wherein:

(a) each of said adjustable distributing blade wing portions includes an independent wing operating means which is also selectively, independently and individually operable via said car mounted receiver and said mobile transmitter means.

10. On a train including a plurality of railroad cars, each car including a plurality of hopper discharge openings, each with a hopper door, and at least one ballast distributing blade attached beneath the car, said blade being movable between a non-operative position and an operative position, a hopper door and blade control apparatus for controlling said doors and said blade, said apparatus comprising:

(a) door operating means associated with each said door for selectively opening and dosing the associated door;

(b) blade operating means associated with said blade for selectively moving said blade between said operative and said non-operative positions;

(c) a receiver on each car connected to the respective door and blade operating means on that car, said receiver being responsive to coded control signals to selectively, independently and individually control positions of said doors and said blade, each said receiver being adapted to respond to a different coded address signal; and (d) a mobile remote transmitter selectively operable to transmit any one of said coded address signals and said coded control signals to cause a selected one of said receivers to control the connected door and blade operating means.

11. An apparatus as set forth in claim 10, wherein:

(a) said door and blade operating means each comprise a hydraulic actuator.

12. An apparatus as set forth in claim 11, wherein:

(a) each said car includes an electrical generator and a hydraulic fluid pump.

13. An apparatus as set forth in claim 10, wherein:

(a) there are a pair of said ballast distributing blades on each said car, one blade being attached toward each end of each car, and each said blade has an independent blade operating means associated therewith.

14. An apparatus as set forth in claim 13, wherein:

(a) each of said ballast distributing blades is shaped as a V, with the center portions of the V blades on each car extending toward each other such that each said car can distribute ballast while said train is in motion in either direction on a railroad track.

15. An apparatus as set forth in claim 13, wherein:

(a) one or more of said ballast distributing blades is adjustable and includes at least one wing portion which is extendable and retractable to selectively change the effective width of said blade.

16. An apparatus as set forth in claim 15, wherein:

(a) each of said adjustable ballast distributing blades includes a pair of said wing portions.

17. An apparatus as set forth in claim 15, wherein:

(a) each of said adjustable distributing blade wing portions includes an independent wing operating means which is also selectively, independently and individually operable via the associated car mounted receiver and said mobile transmitter means.

18. A method of selectively, independently and individually controlling a plurality of hopper doors and one or more ballast distributing blades on a railroad hopper car, each said door being selectively movable between an open and a closed position, and each said blade being movable between an operative and a non-operative position, the method comprising the steps of:

(a) attaching a reversible power source to each said door and each said blade;

(b) connecting a receiver to all of said power sources to selectively, independently and individually control the switching and direction of each of said power sources in response to uniquely encoded control signals; and (c) transmitting said encoded control signals to said receiver from a mobile remote transmitter.

19. The method of claim 18, wherein there are a plurality of hopper cars on a train, each car including a plurality of doors and blades, each car also including a respective one of said receivers, said method including the steps of:

(a) adapting each receiver to respond to a unique coded receiver address signal;

(b) causing said remote transmitter to send a selected one of said receiver address signals so that a single selected receiver is enabled thereby.

20. In a railroad hopper car equipped for operation on a pair of railroad rails, said car including at least one material containing hopper, each hopper including a hopper door for dropping material in the hopper beneath the railroad car, the improvement comprising:

(a) a pair of V shaped material distributing blades attached beneath said railroad car, each said blade being of a width which simultaneously encompasses both rails of a railroad track, with each said blade being selectively movable between a lowered, operative position in which the blade is positioned to push material dropped from said car off of said rails and a raised, non-operative position, one of said blades being located between said hopper door and one end of said car and the other of said blades being located between said hopper door and the opposite end of said car with said blades being oriented with the center portions of their respective V's pointing toward each other; and (b) a pair of blade operating means for respectively, selectively moving said blades between said operative and said non-operative positions such that one of said blades can be properly positioned to push said material dropped from said car regardless of the direction of travel of said railroad car.

21. A railroad hopper car as in claim 20, wherein each said blade further comprises:

(a) at least one wing portion which is extendable and retractable to thereby adjust the effective width of said blade; and (b) wing operating means for selectively extending and retracting said wing portion.

22. A railroad hopper car as in claim 21, wherein:

(a) each said blade comprises a pair of said wing portions and a corresponding pair of said wing operating means.

23. A railroad hopper car as in claim 21, wherein:

(a) each of said wing operating means comprises a hydraulic actuator means.

24. A railroad hopper car as in claim 20, wherein:

(a) each of said blade operating means comprises a hydraulic actuator means.

25. A railroad hopper car as in claim 24, wherein:

(a) each of said blades is pivotably attached beneath said railroad car, and each of said hydraulic actuator means is operative to pivot the respective blade between said raised, non-operative position and said lowered, operative position.

26. A railroad hopper car as in claim 20, wherein each of said blades further comprises:

(a) roller means for contacting and rolling along said rails when said blade is in said operative position to thereby otherwise hold said blade just clear of said rails.

27. A railroad hopper car as in claim 20, wherein each of said hopper doors includes a door operating means, the improvement further comprising:

(a) control means for remotely controlling said blade and said doors, said control means including:

(i) a receiver on said car connected to the respective door and blade operating means on the car, said receiver being responsive to coded control signals to selectively, independently and individually control positions of each of said doors and said blades; and (ii) a mobile remote transmitter selectively operable to transmit any one of said coded control signals to cause said receiver to control the connected door and blade operating means.

28. In a railroad hopper car equipped for operation on a pair of railroad rails, said car including at least one material containing hopper, each hopper including a hopper door for dropping material in the hopper beneath the railroad car, each said hopper door including a door operating means, the improvement comprising:

(a) at least one material distributing blade attached beneath said railroad car, said blade being selectively movable between an operative position in which the blade is positioned to push material dropped from said car off of said rails and a non-operative position;

(b) blade operating means for selectively moving said blade between said operative and said non-operative positions; and (c) control means for remotely controlling said blade means and each said door, said control means including:

(i) a receiver on said car connected to the respective door and blade operating means on the car, said receiver being responsive to coded control signals to selectively, independently and individually control positions of each said door and said blade means; and (ii) a mobile remote transmitter selectively operable to transmit any one of said coded control signals to cause said receiver to control the connected door and blade operating means.

* * * * *